US008934639B2

(12) United States Patent
Budinger et al.

(10) Patent No.: US 8,934,639 B2
(45) Date of Patent: Jan. 13, 2015

(54) MODIFICATION OF AUDIO SIGNALS FOR DISTRIBUTION IN A ROOM

(75) Inventors: Tilo Budinger, Hamburg (DE); Carsten Vogel, Hamburg (DE)

(73) Assignee: Airbus Operations GmbH (DE)

( * ) Notice: Subject to any disclaimer, the term of this patent is extended or adjusted under 35 U.S.C. 154(b) by 773 days.

(21) Appl. No.: 12/706,157

(22) Filed: Feb. 16, 2010

(65) Prior Publication Data

US 2010/0208913 A1 Aug. 19, 2010

Related U.S. Application Data

(60) Provisional application No. 61/207,906, filed on Feb. 18, 2009.

(30) Foreign Application Priority Data

Feb. 18, 2009 (DE) ..... 10 2009 009 490

(51) Int. Cl.
*H04R 27/00* (2006.01)

(52) U.S. Cl.
CPC ..... *H04R 27/00* (2013.01)
USPC ..... 381/82; 381/86

(58) Field of Classification Search
CPC ..... H04R 27/00; H04R 3/12; H04R 27/02; H04R 2499/13; H04R 5/02
USPC ..... 381/1, 17, 56, 61, 63, 98, 150, 82, 120; 181/187, 188
See application file for complete search history.

(56) References Cited

U.S. PATENT DOCUMENTS

| | | | | |
|---|---|---|---|---|
| 6,764,046 | B2 * | 7/2004 | Itakura et al. | 244/118.5 |
| 2003/0132056 | A1 * | 7/2003 | Meyer et al. | 181/187 |
| 2004/0234076 | A1 | 11/2004 | Agostini | |
| 2005/0259831 | A1 | 11/2005 | Hutt et al. | |
| 2006/0159286 | A1 | 7/2006 | Stiles et al. | |
| 2008/0212805 | A1 | 9/2008 | Fincham | |
| 2009/0238372 | A1 * | 9/2009 | Hsu | 381/61 |
| 2010/0135505 | A1 * | 6/2010 | Graebener et al. | 381/82 |

FOREIGN PATENT DOCUMENTS

DE 102006049030 B3 4/2008

* cited by examiner

*Primary Examiner* — Lun-See Lao
(74) *Attorney, Agent, or Firm* — Lerner, David, Littenberg, Krumholz & Mentlik, LLP

(57) ABSTRACT

A device for modifying audio signals to be output within a room is introduced. The device exhibits an input for supplying audio information and a processor unit for modifying the audio information. The device further exhibits at least two outputs for distributing respectively modified audio information. The processor unit is here adapted to modify the audio information in such a way that respective sound sources to be connected to the outputs simulate a linear sound source for outputting the audio information according to the audio signals. The linear sound source is here achieved via the coherent coupling of a plurality of point sound sources, for example loudspeakers.

10 Claims, 3 Drawing Sheets

MODIFICATION OF AUDIO SIGNALS FOR DISTRIBUTION IN A ROOM

CROSS-REFERENCE TO RELATED APPLICATIONS

This application claims the benefit of the filing date of U.S. Provisional Patent Application No. 61/207,906 filed Feb. 18, 2009, the disclosure of which applications is hereby incorporated herein by reference.

FIELD OF THE INVENTION

The present invention relates to a device for modifying audio signals to be emitted within a room, in particular for modifying audio contents envisaged for distribution inside an aircraft cabin. In addition, the invention relates to an aircraft with a device according to the invention, a method for modifying audio information, a computer program element and a computer-readable medium.

BACKGROUND OF THE INVENTION

In the area of distributing and feeding audio signals, many applications place great value on a high quality of the audio signals, and a good perceptibility of the latter at each point in a room. The quality and volume of audio contents can enhance the comfort of the listener depending on application, for example in stereo systems for private use or at concerts. However, the probability of passenger survival can also depend on a good perceptibility of audio signals at every point in a room in certain situations, for example during air travel when important announcements are being made from the cockpit.

Therefore, it is very important during air travel in particular that the pilot or crew announcements or safety demonstrations before takeoff be made readily audible to the passengers at every point in the aircraft cabin.

A plurality of individual loudspeakers allocated over the length of the cabin is today used for distributing audio contents within the aircraft cabin, for example announcements, onboard music, instructions and chimes (fasten seat belt signal, bell). The loudspeakers are here e.g. integrated in the passenger service unit (PSU) above the heads of the passengers, and operated via so-called passenger interface supply adapters (PISA). The propagation of sound waves emitted by the loudspeakers can by rough approximation be compared to spherical waves coming from point sound sources. For example, a loudspeaker system for an aircraft cabin is known from DE 10 2006 049 030 B.

The necessity of incorporating a plurality of loudspeakers can result in a major installation, wiring and maintenance outlay. Further, the high number of loudspeakers can entail a high power consumption.

Therefore, one object of the present invention may be regarded as providing a device that makes it possible to achieve an improvement of audio function or of the audio signals to be emitted within the room given a preferably constant or lower number of loudspeakers.

BRIEF SUMMARY OF THE INVENTION

This object may be achieved with the subject matter of the present invention according to the independent claims. Advantageous embodiments of the present invention are described in the dependent claims.

In a first aspect of the present invention, a device for modifying audio signals to be emitted within a room is described. The device exhibits an input for feeding audio information, a processor unit for modifying of audio information, and at least two outputs for relaying the respectively modified audio information. The processor unit is here equipped to modify the audio information in such a way that sound sources to be connected to the respective outputs realize a quasi-linear sound source for outputting audio signals corresponding to the audio information.

Expressed differently, the idea of the present invention according to the first aspect is based on changing an audio information in such a way that it can be supplied to a predetermined number of loudspeakers connected to the outputs of a processor unit, during which the numerous individual loudspeakers act as a linear sound source during the output of audio signals via the loudspeakers owing to the interaction of the modified audio information. To this end, audio information, for example a pilot announcement, is fed through an input of a processor unit. In this processor unit, this audio information is modified based on predetermined parameters and algorithms in such a way that the audio signals do not cancel each other out during output at the loudspeakers, but rather are superposed in such a way as to ensure good hearing quality and good volume at each point of the room. This is achieved by simulating a linear sound source. The linear sound source can here be achieved via coherent coupling of a plurality of point sound sources, such as loudspeakers. The number of outputs can correspond to the number of loudspeakers, so that the audio information can be output to the connected loudspeakers as an audio signal after having been processed in the processor unit.

Features, details and possible advantages of a device according to embodiments of the invention will be described in depth below.

For example, the modification of audio information can take the form of a spectral breakdown of the audio content. Further, the modification can incorporate a change in frequencies following the spectral breakdown. In addition, the modification can be a chronological change, such as a delay, level increase and/or decrease, in particular of specific frequency bands calculated by the processor unit. The modification of audio information can be both qualitative and quantitative. For example, parameters of the subsequently output audio signals, such as sound pressure levels and power density, can be changed at specific points in the room.

The modification of the audio information in the processor unit takes place with an eye toward the output of audio signals within a room. The audio signal quality can be readily predetermined and influenced by the modification if the room is closed, and the dimensions of the room are known, for example. However, the room can also be a free space, such as at an open-air concert.

The modification that takes place in the device according to the invention may be effected using electrical means. This means that the modification is based not just on mechanical means, such as funnels or waveguides, of the kind commonly used at open-air concerts to diminish the angle of emission of a loudspeaker.

The audio signal that can be converted by loudspeakers can be an sound signal that transports acoustic information. The audio signal can be discernible by the human ear, and range between about 20 Hz and 20 kHz. The perceptibility of the audio signal by a listener also depends on a sound pressure level.

The audio information that is modified in the processor unit can be an analog or digital acoustic signal, for example, which is fed to the processor unit. In the case of an analog signal, the signal can be converted in the processor unit into a digital signal. The audio information can encompass announcements, instructions, music or sounds.

The processor unit in which the audio information is modified can be a computer or a CPU (central processing unit). The processor unit can preferably be a DSP unit (digital signal processor unit). The processor unit can be suitable for quickly carrying out a high number of mathematical computing operations on a data record. For example, the algorithms executed on the processor unit act as a frequency filter with a very precise phase resolution.

The audio information delivered to the processor unit can be analog or digital. The processor unit can be equipped to convert analog information into digital information or vice versa. For example, this can be accomplished by means of analog-to-digital converters and digital-to-analog converters, which are integrated into the processor unit. The processor unit can be equipped to process or modify the audio information in real time, and deliver it to the outputs and sound sources connected thereto, for example loudspeakers.

The input of the device can be connected with additional elements, such as a microphone or a processor. The outputs of the device according to the invention can be connected with sound sources, for example loudspeakers. In this case, additional elements, such as amplifiers, analog-to-digital or digital-to analog converters and further processors can be integrated between the outputs and the sound sources. The device exhibits at least two outputs. A higher number of outputs can help achieve a better result during the simulation of a linear sound source.

The audio information provided at the outputs of the device can be used to simulate a linear sound source. The linear sound source is simulated by virtue of the fact that the individual sound sources connected to the outputs deliver an audio signal modified in such a way that the individual signals are superposed onto each other. This superposing of signals is such that interferences and chronological delays of the individual signals give the listener the impression of a linear sound source.

A linear sound source is characterized in that the surfaces with an identical oscillation phase can be regarded as cylindrical surfaces. The radiated power of a linear sound source is distributed to double the surface given a doubling of the distance away from the listener. The power density here decreases by half (−3 dB), and the sound pressure level diminishes correspondingly by a factor of 0.707. By contrast, the power density in the case of a point sound source, which can be compared to a single loudspeaker, decreases more rapidly as distance increases. This can be explained by the larger surface of a spherical wave, which emanates from a point sound source. The power density would theoretically decrease by −6 dB given a doubling of the distance away from the listener for such a point sound source. These values are based on theoretical calculations, and cannot be optimally realized or achieved using a sound source with a linear configuration, for example.

The modification of audio information in the processor unit as described in the invention may make it possible to simulate a linear sound source using the interference of audio signals output by the individual loudspeakers that is good enough to make the theoretical values achievable. To this end, it is not absolutely necessary for the loudspeakers arranged at the outputs of the processor to be arranged along a line, but their location or position in the room must be known and present as a parameter in the processor unit. It can further be advantageous for the loudspeakers to be arranged close together. The distance between two loudspeakers arranged at the outputs is preferably less than 10 cm, in particular less than 5 cm. It is most preferable that the distance between the loudspeakers be less than the radiating surface of the respective loudspeaker.

Simulating a linear sound source via the modification of audio information in the processor unit makes it possible to use the same number of sound sources in achieving a better signal quality and volume. This implies that the number of sound sources can be reduced, while at the same time retaining the original audio information. For example, this can yield a reduced installation outlay, decreased wiring outlay, along with a lower maintenance outlay inside an aircraft cabin. Further, such a configuration can make it possible to more quickly install the end line of the sound sources.

According to one embodiment of the present invention, the processor unit is designed to simulate the linear sound source via adjusted, frequency-dependent delay of audio information.

Adjusted delay can here mean that the delay of specific frequencies or frequency ranges of the audio information is oriented toward previously known parameters, for example the spatial arrangement of the sound sources. Further, the frequency-dependent delay of audio information can also be adjusted to other characteristics of the sound sources.

The frequency-dependent delay can be preceded by an initial spectral breakdown of the audio information in the processor unit. The chronological delay (also referred to as delay) can vary depending on frequency or frequency range. For example, identical frequencies or frequency bands can be provided at various sound sources in a time-shifted manner.

The adjusted, frequency-dependent delay of audio information makes it possible to effect an interference of the audio signals output by the individual sound sources, so that a linear sound source can be better simulated, which can yield an improved audio signal quality and intensity.

In another embodiment of the present invention, the processor unit is designed to spectrally filter the audio information. Further, the processor unit is designed to change the audio information in its chronological and/or spectral composition during the modification.

Spectral filtering of audio information can involve a breakdown into the individual frequencies or frequency bands of the audio information. Further, spectral filtering can involve a subsequent selection of specific frequencies or frequency bands.

During modification in the processor unit, the audio information is chronologically and/or spectrally changed. The audio information is here preferably both delayed and altered in terms of its spectral composition. A combined chronological and spectral change in the composition of the audio information makes it possible to better achieve the desired effects of a linear sound source.

According to another embodiment of the present invention, the device further exhibits an amplifier unit. The amplifier unit is here designed to amplify the audio information at at least one of the outputs.

The amplifier unit can be integrated into the device according to the invention. It can be connected with the outputs of the device. As an alternative, the amplifier unit can be arranged at the outputs. In addition, a separate amplifier unit can be allocated to each output. The amplifier unit can consist of several elements, and process the audio information in such a way that an output parameter, for example the output voltage, output current or output power, is greater than the corresponding input parameter.

Amplifying the audio information or audio signal, which is relayed on to the sound sources, ensures a better signal quality.

In another embodiment of the present invention, the device exhibits at least two loudspeakers. The loudspeakers are here each connected with one of the outputs. The processor unit is here designed to consider parameters typical to loudspeakers while modifying the audio information.

In this case, a respective loudspeaker can be allocated to each output of the device. The loudspeaker can here convert the audio information modified by the processor unit and provided at the outputs into sound. The loudspeakers can be installed in an aircraft, for example, and relay crew announcements to the passengers. Further, the outputs can be connected with the outputs of the device by cables, for example. As an alternative, information can be wirelessly transmitted from the outputs of the device to the loudspeakers.

During the modification of audio information, the processor unit takes into account parameters typical for loudspeakers. These parameters can include the distance between the loudspeakers, their size, as well as their distribution in the room. Other loudspeaker parameters that can be taken into account are frequency response, phase response and pulse fidelity of the respective loudspeaker. Prior to modification of the audio information, the parameters typical of loudspeakers can be measured and input or present in the processor unit. The loudspeaker-typical parameters can be taken into account while modifying the audio information. As an alternative, the modification of audio information can be based predominantly on the loudspeaker-typical parameters.

Taking into account loudspeaker-typical parameters when modifying the audio information makes it possible to simulate a linear sound source in a particularly accurate manner.

In another embodiment of the present invention, the processor is designed to modify the audio information for each loudspeaker individually.

A second aspect of the present invention describes an aircraft having a device according to the invention.

In another embodiment of the present invention, the aircraft has a cabin with a room separator. The device according to the invention is here arranged at the room separator.

A room separator can be a wall between the cabin and onboard kitchen, or a separating wall between first and second class, for example. Further, a cabin can be divided into several sections at various locations by several room separators. A room separator can divide the cabin on both a vertical and horizontal plane. Further, a room separator can also be slanted in relation to the horizontal and vertical, and consist of several structural components. The device according to the invention can be integrated in the room separator, or be arranged on the room separator. The room separator can accommodate only a portion of the device, such as the loudspeakers, or the entire device, with processor unit and loudspeakers.

The central attachment of the device, e.g., on room separators in the aircraft, makes it possible to reduce the number of necessary loudspeakers. Among other things, this may results in a less complex structural design, and a less complicated cable distribution, which in turn saves on production and maintenance costs. Further, the omission of loudspeakers normally arranged in the passenger service unit (PSU) makes it possible to improve and simplify the PSU channel.

A third aspect of the present invention provides a method for modifying audio signals that are emitted within a room. The method consists of the following steps: Feeding audio information to a processor unit via an input; modifying the audio information via the processor unit so that respective sound sources to be connected to the outputs simulate a linear sound source for outputting audio signals corresponding to the audio information; relaying the respectively modified audio information to at least two outputs.

A fourth aspect of the present invention provides a computer program element. The computer program element is here designed to execute the method described above when performed on a processor.

In another embodiment of the present invention, the processor on which the computer program element is implemented is a DSP unit.

A fifth aspect of the present invention provides a computer-readable medium. The program element described above is here stored on the medium.

Additional features and advantages of the present invention become evident to the expert form the following description of exemplary embodiments, which are not to be construed as limiting the invention, however, drawing reference to the attached drawings.

All figures are only diagrammatic depictions of devices from prior art, devices according to the invention or their components, and the corresponding methods. In particular distances and dimensional correlations are not reflected true to scale on the figures. The same or identical elements are provided with the same reference numbers on the various figures.

DETAILED DESCRIPTION

Figure 1:
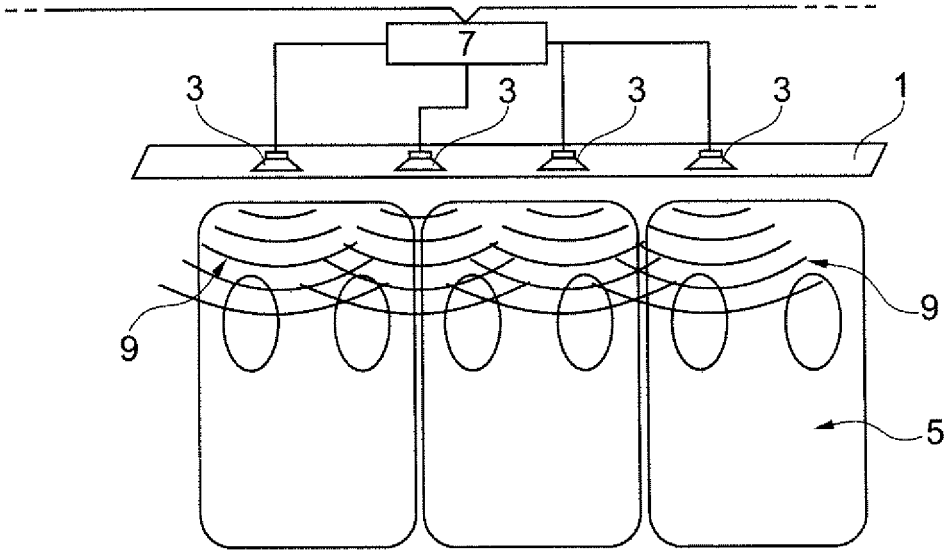
FIG. 1 shows a diagrammatic view of a loudspeaker system in an aircraft according to prior art.

FIG. 1 presents a diagrammatic view of a loudspeaker system in an aircraft according to prior art. An audio signal 7 is directly distributed to several loudspeakers. The loudspeakers are arranged or integrated in a passenger service unit (PSU) 1. The PSU 1 is situated over the heads of the passengers and the windows. The individual loudspeakers 3 act as nearly point sound sources. The wave fronts 9 of the signals emanating from the loudspeakers 3 propagate as spherical waves in the aircraft cabin 5, and can in the process be unfavorably superposed or even cancel each other out.

Figure 2A:
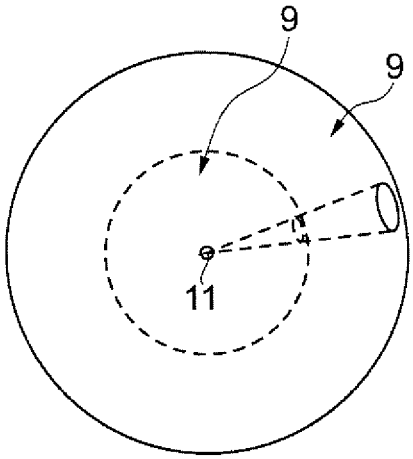
FIG. 2*a* schematically shows a theoretical model of the sound ware propagation in case of a point-like sound source.

In order to illustrate the theoretical considerations, FIG. 2*a* provides a diagrammatic view of a theoretical model of sound wave propagation given a point sound source. The loudspeakers 3 from FIG. 1 can be approximated as point sound sources 11, for example. FIG. 2*a* shows two wave fronts 9. A spherical surface is known to be proportional to the square of the radius of the sphere. As a result, the surface of the spherical waves emanating from a point sound source increases proportionally to $r^2$ given an increasing distance r from the point sound source. Hence, the energy density also is distributed over a continuously greater surface as the distance to the sound source increases, and tapers off with $1/r^2$. Consequently, the power per surface diminishes to ¼ (i.e., by −6 dB) given a doubling of the distance r. The wave amplitude of the spherical waves is reduced to 1/r correspondingly given a doubling of the distance.

Figure 2B:
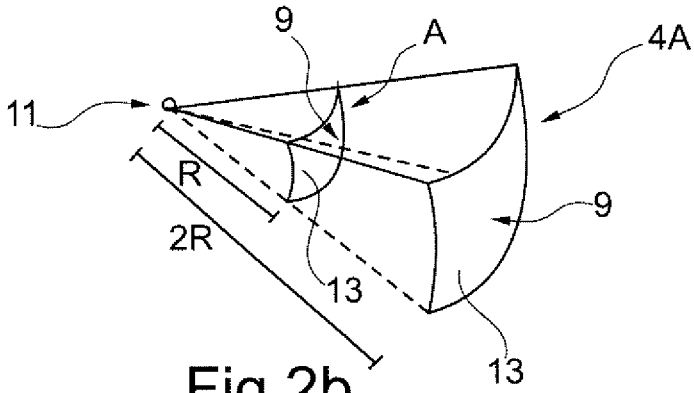
FIG. 2*b* shows a section from the depiction on FIG. 2*a;*

FIG. 2*b* illustrates this yet again based on a section of FIG. 2*a*. FIG. 2*b* depicts two surface segments 13 of a wave front 9 of a point sound source 11. A surface segment 13 is a distance R away from the sound source 11. A wave front or potential listener can be located at this distance R. The surface segment 13 located at distance R from the sound source 11 has surface A. A further surface segment 13 is situated a distance 2R away from the point sound source 11, meaning at double the distance. This second surface segment 13, which is located at double the distance away from the point sound source 11, has surface 4A. This means that the surface or surface segment 13 of a spherical wave quadruples given a doubling of the distance.

Figure 3:
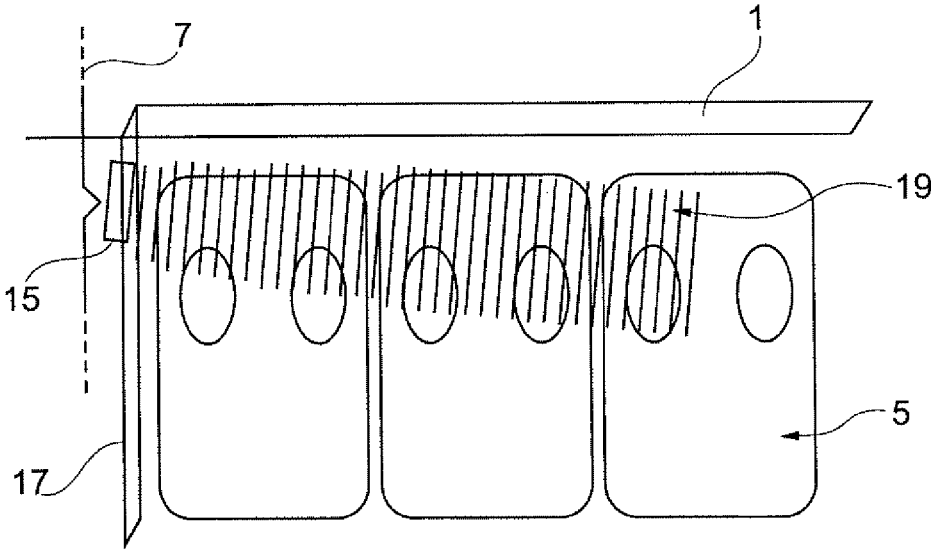
FIG. 3 shows a diagrammatic view of the device according to the invention in an aircraft.

FIG. 3 provides a diagrammatic view of a device according to the invention in an aircraft. An audio signal 7 is supplied to a sound source 15. In this case, the sound source can be a loudspeaker system comprised of several loudspeakers 3. The sound source 15 is here integrated into a room separator 17 or arranged on the room separator 17.

The sound source 15 simulates a linear sound source, in which the wave fronts can be depicted as cylinders. The linear sound source is here achieved via coherent coupling of a plurality of point sound sources, e.g., the loudspeakers 3 depicted above. Instead of a plurality of loudspeakers 3, loudspeaker lines can also be installed at central locations accordingly.

The wave fronts 19 coming from the sound source 15 can be regarded as cylindrical surfaces. In the view thereof shown on FIG. 3, the wave fronts 19 are presented as lines. Expressed differently, the surfaces with the same oscillation phase are to be regarded as cylindrical surfaces. In the models for the propagation of spherical or cylindrical wave fronts, the propagation conditions must always be presumed as constant for the sound waves. The integration of the sound source 15 in the room separator 17 enabled with the device according to the invention now simplifies the PSU unit 1 by omitting the loudspeakers 3. The operation and advantages of a linear acting sound source 15 will now be described in the following figures.

Figure 4A:
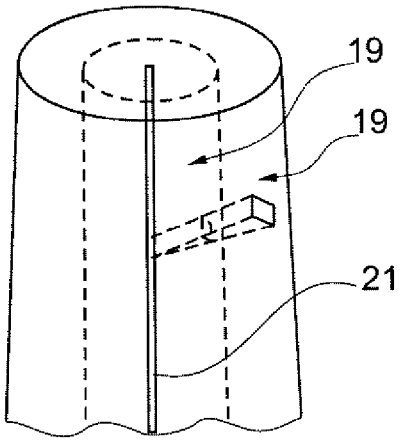
FIG. 4*a* shows a diagrammatic view of a theoretical model of the sound wave propagation given a linear sound source.

FIG. 4*a* provides a diagrammatic view of a theoretical model for sound wave propagation given a linear sound source 21. The linear sound source 21 emits cylindrical wave fronts 19 of the same oscillation phase. The surface of a cylindrical jacket is known to be proportional to the radius of the cylinder. Power or energy radiated from the linear sound source 21 is hence distributed over double the surface given a doubling of a stretch R. The power density is here reduced by half (i.e., −3 dB), and the sound pressure level decreases correspondingly by a factor of 0.707.

Figure 4B:
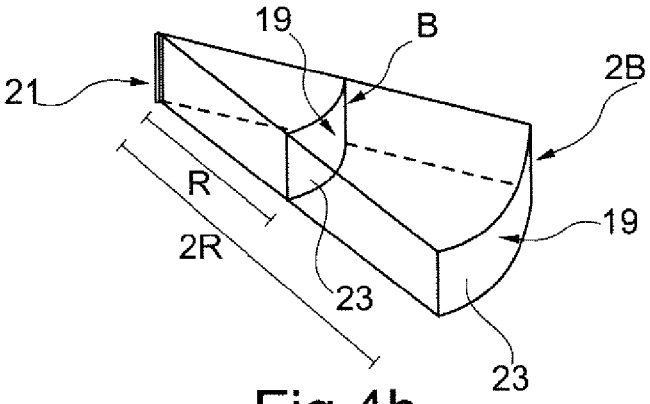
FIG. 4*b* shows a section of the depiction from FIG. 4*a;*

This is illustrated yet again on FIG. 4*b*, which depicts a section of FIG. 4*a*. FIG. 4*b* shows two surface segments 23 of the cylindrical wave fronts 19. A surface segment 23 is located a distance R away from the linear sound source 21. The surface of this surface segment 23 is B. Further depicted is a surface segment 23 a distance 2R away from the linear sound source 21. The surface of this segment corresponds to 2B. In other words, in contrast to the point source 11, the surface of the cylindrical wave front 19 has only doubled given double the distance from the sound source 21. As a result, the surface over which the energy of the sound waves must be distributed with an increasing distance from the sound source rises more slowly for cylindrical wave fronts than for spherical wave fronts. Hence, the power density and sound pressure level also taper off less rapidly for a linear sound source than for a point sound source, as demonstrated above. This is illustrated yet again on FIG. 5.

Figure 5:
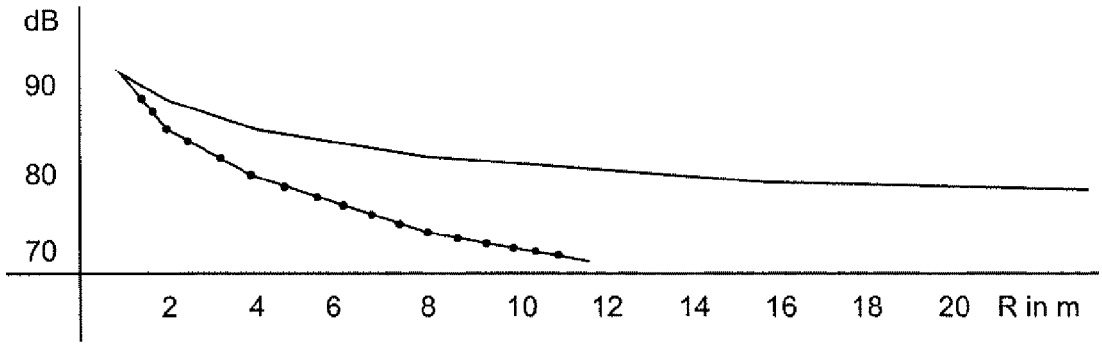
FIG. 5 shows a diagrammatic graph with a depiction of the drop in sound energy density with increasing distance for a point and linear sound source.

FIG. 5 presents a diagrammatic chart showing the drop in sound energy density as distance increases for a point and linear sound source. The distance r between the wave front or a potential listener and the sound source is recorded on the x-axis. The y-axis records the sound energy density or power density in decibels. The lower line provided with points here represents the sound energy density of a point sound source 11 that decreases with an increasing distance r. The upper line shows the flatter, slower taper in sound energy density with a rising distance r for a linear sound source 21.

Figure 6:
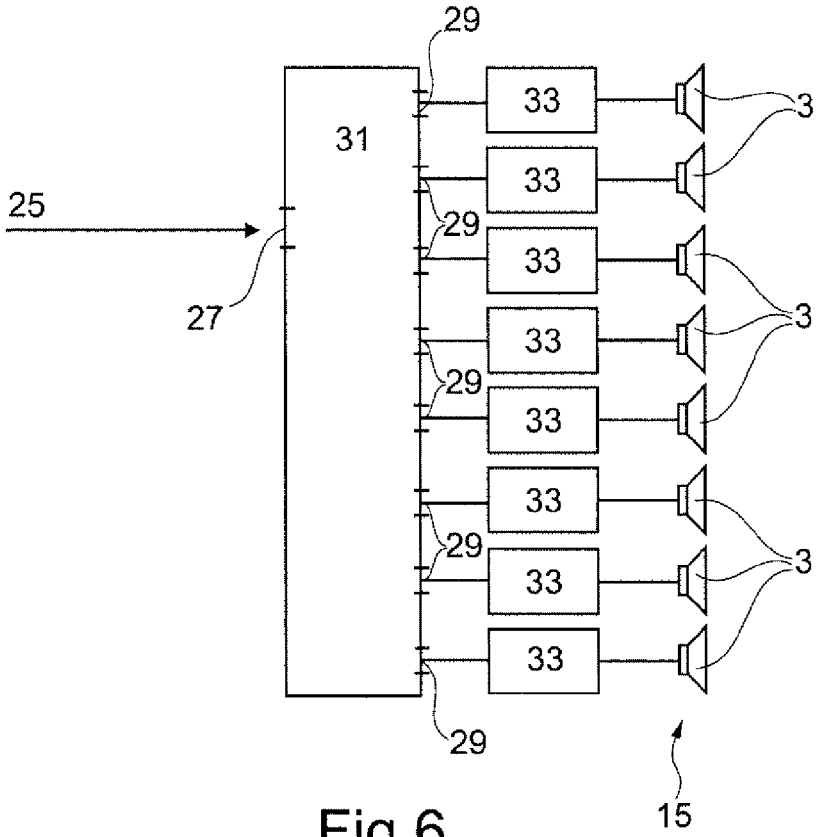
FIG. 6 shows a device according to an exemplary embodiment of the invention.

FIG. 6 shows a device according to an exemplary embodiment of the present invention. FIG. 6 depicts a processor unit 31 with an input 27 and several outputs 29. Audio information 25, such as a pilot announcement, is routed through the input 27 to the processor unit 31. In the processor unit 31, the audio information 25 is modified in such a way that the sound sources 3 connected with the outputs 29 simulate a linear sound source. The sound sources or loudspeakers 3 output the audio information 25 as audio signals 7. The loudspeakers 3 can here operate together as a loudspeaker system 15. Incorporated between the outputs 29 and loudspeakers 3 are amplifiers, which amplify the audio information 25 or audio signals 7. The coherent coupling of loudspeakers 3 can in this way simulate a linear sound source.

In other words, signal processing is realized as follows: The audio information 25 is fed to a processor unit 31, for example a DSP unit with an input and a plurality of outputs. The input signal is processed and provided at the outputs 29. The output signals are amplified and each sent to a loudspeaker 3. Simulating a linear sound source in this way yields the advantages already mentioned above.

In conclusion, let it be noted that terms such as "exhibiting", "comprising" or the like are not intended to preclude the provision of further elements or steps. In addition, let it be noted that "one" or "an" do not preclude a plurality. Further, features described in conjunction with the various embodiments can be combined with each other as desired. Let it also be noted that the reference numbers in the claims are not to be construed as limiting the scope of the claims.

REFERENCE LIST

1 Passenger Service Unit (PSU)
3 Loudspeaker
5 Aircraft cabin
7 Audio signal
9 Wave front of a nearly point sound source
11 Point sound source
13 Surface segment of a wave front of a nearly point sound source
15 Sound source
17 Room separator
19 Wave front of a nearly linear sound source
21 Linear sound source
23 Surface segment of a wave front of a nearly linear sound source
25 Audio information
27 Input
29 Output
31 Processor unit
33 Amplifier R Distance between the wave front or a potential listener and a sound source A Surface of a segment of a wave front of a nearly point sound source B Surface of a segment of a wave front of a nearly linear sound source

The invention claimed is:

1. A device for modifying audio signals to be output within an aircraft cabin, wherein the device comprises:

an input for supplying audio information;

a processor unit for modifying the audio information; and at least first and second outputs for relaying of respective modified audio information;

wherein the processor unit is adapted to modify the audio information in such a way that respective sound sources to be connected to the outputs simulate a linear sound source for outputting audio signals corresponding to the audio information;

wherein wave fronts with an identical oscillation phase coming from the simulated linear sound source comprise cylindrical surfaces; and wherein the respective sound sources are point sound sources and the simulated linear sound source is achieved via coherent coupling of said point sound sources.

2. The device of claim 1, wherein the processor unit is adapted to simulate the linear sound source via adjusted, frequency-dependent delaying of audio information.

3. The device of claim 1, wherein the processor unit is adapted to spectrally filter the audio information; and wherein the processor unit is further adapted to change the audio information given a modification of a parameter selected from the group consisting of chronological composition, spectral composition, and a combination thereof.

4. The device of claim 1, wherein the device further comprises an amplifier unit;

wherein the amplifier unit is adapted to amplify the audio information at at least one of the outputs.

5. The device of claim 1, further comprising at least first and second loudspeakers;

wherein the first and second loudspeakers are connected with the first and second outputs, respectively;

wherein the processor unit is adapted to consider loudspeaker-typical parameters given the modification of the audio information.

6. The device of claim 5, wherein the processor unit is adapted to individually modify the audio information for each loudspeaker.

7. An aircraft comprising:

a device for modifying audio signals to be output within an aircraft cabin, wherein the device comprises:

an input for supplying audio information;

a processor unit for modifying the audio information;

at least first and second outputs for relaying of respective modified audio information;

wherein the processor unit is adapted to modify the audio information in such a way that respective sound sources to be connected to the outputs simulate a linear sound source for outputting audio signals corresponding to the audio information, the respective sound sources being point sound sources and the simulated linear sound source being achieved via coherent coupling of said point sound sources; and wherein wave fronts with an identical oscillation phase coming from the simulated linear sound source comprise cylindrical surfaces; and a room separator in the cabin, wherein the device is arranged at the room separator.

8. A method for modifying audio signals output within a cabin of an aircraft, wherein the method comprises:

supplying audio information through an input to a processor unit;

modifying the audio information via the processor unit in such a way that respective sound sources to be connected to at least first and second outputs simulate a linear sound source for outputting audio signals corresponding to the audio information;

wherein the respective sound sources are point sound sources and the simulated linear sound source is achieved via coherent coupling of said point sound sources;

wherein wave fronts with an identical oscillation phase coming from the simulated linear sound source comprise cylindrical surfaces; and relaying the respectively modified audio information to at least two outputs.

9. A non-transitory computer readable medium having a computer readable program code embodied therein, said computer readable program code adapted to be executed to implement a method for modifying audio signals output within a cabin of an aircraft, said method comprising:

supplying audio information through an input to a processor unit;

modifying the audio information via the processor unit in such a way that respective sound sources to be connected to at least first and second outputs simulate a linear sound source for outputting audio signals corresponding to the audio information;

wherein the respective sound sources are point sound sources and the simulated linear sound source is achieved via coherent coupling of said point sound sources;

wherein wave fronts with an identical oscillation phase coming from the simulated linear sound source comprise cylindrical surfaces; and relaying the respectively modified audio information to at least two outputs.

10. The device of claim 1, wherein the sound sources are arranged in a spatial configuration other than cylindrical or conical.

* * * * *